US009065206B2

(12) United States Patent
Lappoehn

(10) Patent No.: US 9,065,206 B2
(45) Date of Patent: Jun. 23, 2015

(54) CONNECTOR AND METHOD FOR THE PRODUCTION THEREOF

(75) Inventor: Juergen Lappoehn, Gammelshausen (DE)

(73) Assignee: ERNI Production GmbH & Co. KG, Adelberg (DE)

( * ) Notice: Subject to any disclaimer, the term of this patent is extended or adjusted under 35 U.S.C. 154(b) by 19 days.

(21) Appl. No.: 14/232,680

(22) PCT Filed: Jul. 10, 2012

(86) PCT No.: PCT/DE2012/000686

§ 371 (c)(1),
(2), (4) Date: Mar. 5, 2014

(87) PCT Pub. No.: WO2013/010525

PCT Pub. Date: Jan. 24, 2013

(65) Prior Publication Data

US 2014/0220810 A1 Aug. 7, 2014

(30) Foreign Application Priority Data

Jul. 15, 2011 (DE) ..... 10 2011 107 768

(51) Int. Cl.
*H01R 24/00* (2011.01)
*H01R 13/621* (2006.01)
*H01R 13/6594* (2011.01)
(Continued)

(52) U.S. Cl.
CPC ..... *H01R 13/621* (2013.01); *H01R 12/7052* (2013.01); *H01R 12/7064* (2013.01); *H01R 12/722* (2013.01); *H01R 13/6215* (2013.01); *H01R 13/6594* (2013.01)

(58) Field of Classification Search
CPC ..... H01R 23/7073; H01R 23/7005
USPC ..... 439/660, 626, 374, 377, 79, 607.36, 439/733
See application file for complete search history.

(56) References Cited

U.S. PATENT DOCUMENTS 4,518,209 A 5/1985 Negley
5,480,328 A 1/1996 Roth et al.
(Continued)

FOREIGN PATENT DOCUMENTS

DE 201 06 408 U1 6/2001
DE 203 05 734 U1 6/2003
(Continued)

OTHER PUBLICATIONS

German Examination Report in DE 10 2011 107 768.9, dated Apr. 18, 2012, with English translation of relevant parts.
(Continued)

*Primary Examiner* — Phuongchi T Nguyen
(74) *Attorney, Agent, or Firm* — Collard & Roe, P.C.

(57) ABSTRACT

A Sub-D connector has a base sheet, to which a plug connector is fastened, and positioning journals for positioning on a printed circuit board and lateral fastening openings for receiving fastening screws or fastening pins, wherein the base sheet comprises lateral tabs which are bent twice essentially at a right angle and surround a plug connector housing at the edges. In the state where the tabs are bent twice, the fastening openings on the front and rear side of the connector are covered by the tabs and the positioning journals are arranged on the part of the tabs which is bent once.

6 Claims, 5 Drawing Sheets

(51) Int. Cl.
*H01R 12/70* (2011.01)
*H01R 12/72* (2011.01)

(56) References Cited

U.S. PATENT DOCUMENTS

| | | | | |
|---|---|---|---|---|
| 5,518,209 | A | 5/1996 | Chicoine et al. | |
| 7,789,702 | B1 | 9/2010 | Xiang et al. | |
| 7,845,981 | B2 | 12/2010 | Vanssay et al. | |
| 8,057,258 | B2 * | 11/2011 | Kawaguchi et al. | 439/585 |
| 8,348,699 | B2 * | 1/2013 | Nagawatari et al. | 439/607.01 |
| 2010/0136832 | A1 * | 6/2010 | Kawaguchi et al. | 439/607.03 |
| 2011/0059653 | A1 | 3/2011 | Yang et al. | |
| 2013/0045631 | A1 * | 2/2013 | Wang | 439/626 |

FOREIGN PATENT DOCUMENTS

| | | | |
|---|---|---|---|
| DE | 20 2006 018 042 | U1 | 5/2007 |
| DE | 20 2008 016 738 | U1 | 3/2009 |
| EP | 0 648 382 | B1 | 2/1996 |
| EP | 0 874 421 | A1 | 10/1998 |

OTHER PUBLICATIONS

International Search Report of PCT/DE2012/000686, mailed Dec. 17, 2012.

* cited by examiner

CONNECTOR AND METHOD FOR THE PRODUCTION THEREOF

CROSS REFERENCE TO RELATED APPLICATIONS

This application is the National Stage of PCT/DE2012/000686 filed on Jul. 10, 2012, which claims priority under 35 U.S.C. §119 of German Application No. 10 2011 107 768.9 filed on Jul. 15, 2011, the disclosure of which is incorporated by reference. The international application under PCT article 21(2) was not published in English.

The invention relates to a so-called sub-D connector according to the independent claims.

DESCRIPTION OF THE PRIOR ART

Such connectors are widely used in the state of the art and are used in computers for example.

A generic connector is disclosed for example in U.S. Pat. No. 5,518,209. In this connector, positioning pins are fixed to the lateral unbent part of the tabs and also the lateral double bent part of the tabs. These parts are aligned perpendicularly to the insertion direction. There is a likelihood of bending during mounting as a result of this arrangement perpendicularly to the insertion direction.

Sub-D connectors are also known from US 2011/0059653 A1, EP 0 648 382 B1 and EP 0 874 421 A1.

A blade connector and a seal for such a blade connector with a base plate are further known from DE 20 2006 018 042 U1, on which a so-called skirt is arranged which surrounds the pin-like plug contacts. Lateral fastening openings in form of boreholes are arranged on the base plate. The connector is fixed in a housing wall for example.

A sub-D connector in SMD technology is known from EP 0 874 421, comprising a base plate which can be fixed to a printed circuit board. The base plate comprises at least one solder projection which is arranged in such a way that it can be soldered by means of SM soldering technique to a soldering point provided on the printed circuit board. The connector has a relatively large general configuration and therefore requires a considerable amount of space on the printed circuit board. In this connector, only soldering projections are arranged on the single bent part of the tabs of the base plate. Positioning pins are arranged on the plug connector housing. Sub-D connectors in the installed state, which are occasionally also referred to as D-sub connectors, are further known for example from the utility model specification 201 06 408 U1 and the utility model specification 203 05 734 U1.

DE 20 2008 016 738 U1 discloses a shielded plug connector, especially a D-sub plug connector, comprising an electrically insulated base body which is provided as a carrier for electrical contacts, a metallic shielding element with a circumferential flange and two electrically conductive, lateral fastening elements. The base body comprises a mounting surface and two openings that open into said mounting surface and extend through the base body. One respective recess is arranged in each of the two openings in the mounting surface, wherein said recess comprises a collar on its inside. The fastening elements respectively comprise a window, which is formed by a frame, wherein the frame is provided for the purpose of being inserted in an interlocking fashion into the respective recess. The configuration of such a plug connector of several individual parts is complex and requires the handling of the different individual parts during mounting.

A sub-D plug connector is also disclosed in U.S. Pat. No. 7,789,702 B1, in which positioning pins are provided which are laterally arranged on the unbent part of the tabs.

The invention is based on the object of further developing a connector, especially a sub-D connector, in such a way that it has a simple configuration and can especially be produced and mounted in a rapid and simple way. It shall especially also be ensured that the positioning pins which are conventionally used in such connectors are not bent during mounting.

DISCLOSURE OF THE INVENTION

Advantages of the Invention

This object is achieved by a connector with the features of claim 1.

It is the fundamental idea of the invention to arrange the lateral tabs which are formed on the base plate of the connector and which are bent twice substantially at a right angle and surround the plug connector housing at the edge in such a way that the fastening openings on the front and rear side of the connector are covered by the tabs in the surrounded state of the plug connector housing, and that the base plate comprises openings which are in alignment with the fastening openings of the plug connector housing in the twice bent state of the tabs. At the same time, a positioning pin is arranged on the tabs, namely on the portion of the tabs which are bent off once. As a result of bending the base plate about the edge of the plug housing, a secure fastening of the plug housing on the base plate and simultaneous shielding are produced, which fastening can be produced in a simple way. Furthermore, it is especially advantageous that the positioning pins are arranged on the side of the tabs which are bent off once. The positioning pins are integrally arranged with the base plate and are therefore arranged on an extension of the plate. As a result of the arrangement on the side which is bent off once, this plate on which the positioning pins are arranged is aligned in the mounted state parallel to the plug-in direction and not perpendicularly to the plug-in direction. This offers great advantages especially in view of bending, and an arrangement of the positioning pins on a plate perpendicularly to the plug-in direction can be bent off in a substantially easier way than an arrangement of the positioning pins on a plate which is arranged parallel to the plug-in direction. In this case, the bending forces are several times higher, so that bending of the positioning pins necessary for the precise positioning of the plug connector cannot be expected.

Advantageous further developments and improvements of the plug connector stated in the independent claim 1 are possible by the measures mentioned in the dependent claims. An advantageous embodiment thus provides for example that the lateral tabs respectively comprise two beads which are arranged in the region of the rectangular bending and are used for defined bending off. These beads allow a defined and precise bending-off in a highly advantageous manner.

The plug connector housing comprises a plastic body in which plug contacts and terminal contacts for a printed circuit board are arranged. Said plastic body is fixed to the base plate, e.g. injected-molded onto said base plate. The plug contacts are blade contacts or spring contacts for example. The terminal contacts for the printed circuit board are preferably SMD contacts, i.e. contacts which have been fixed by surface mount technology to the printed circuit board.

Such a connector is especially positioned at the edge of a printed circuit board. It should take up as little space as possible.

It is preferably provided in order to prevent that erroneous electrical contacts occur that the plug connector housing comprises a plastic tab for insulation of the contact elements in the plug connector on the rear side thereof. Said plastic tab covers the plug contact elements and/or the terminal contacts of the printed circuit board and/or the connecting lines between the plug contacts and the terminal contacts. Said plastic tab can be coupled in a foldable manner in an especially advantageous way to the connector housing. Secure insulation can be achieved in this case after establishing the contact by simply folding down and latching the plastic tab onto the plug connector housing. An especially advantageous embodiment which can be produced in an especially simple way provides that the foldable tab is injection-molded onto the plug connector housing.

The method for producing such a connector is characterized by the following steps:

Fixing of the plug connector to the base plate, e.g. by injection-molding or gluing or the like; bending of the lateral tabs of the base plate in such a way that the insulation housing of the plug connector is laterally surrounded and the fastening openings of the plug connector are surrounded in the bent-off state of the lateral tabs of the base plate both on the front side and also on the rear side of the connector by the tabs of the base plate. This bending simultaneously also positions the positioning pins at the desired position.

BRIEF DESCRIPTION OF THE DRAWINGS

Embodiments of the invention are shown in the drawings and will be explained below in closer detail by reference to the description, wherein.

DETAILED DESCRIPTION OF EMBODIMENTS

Figure 5:
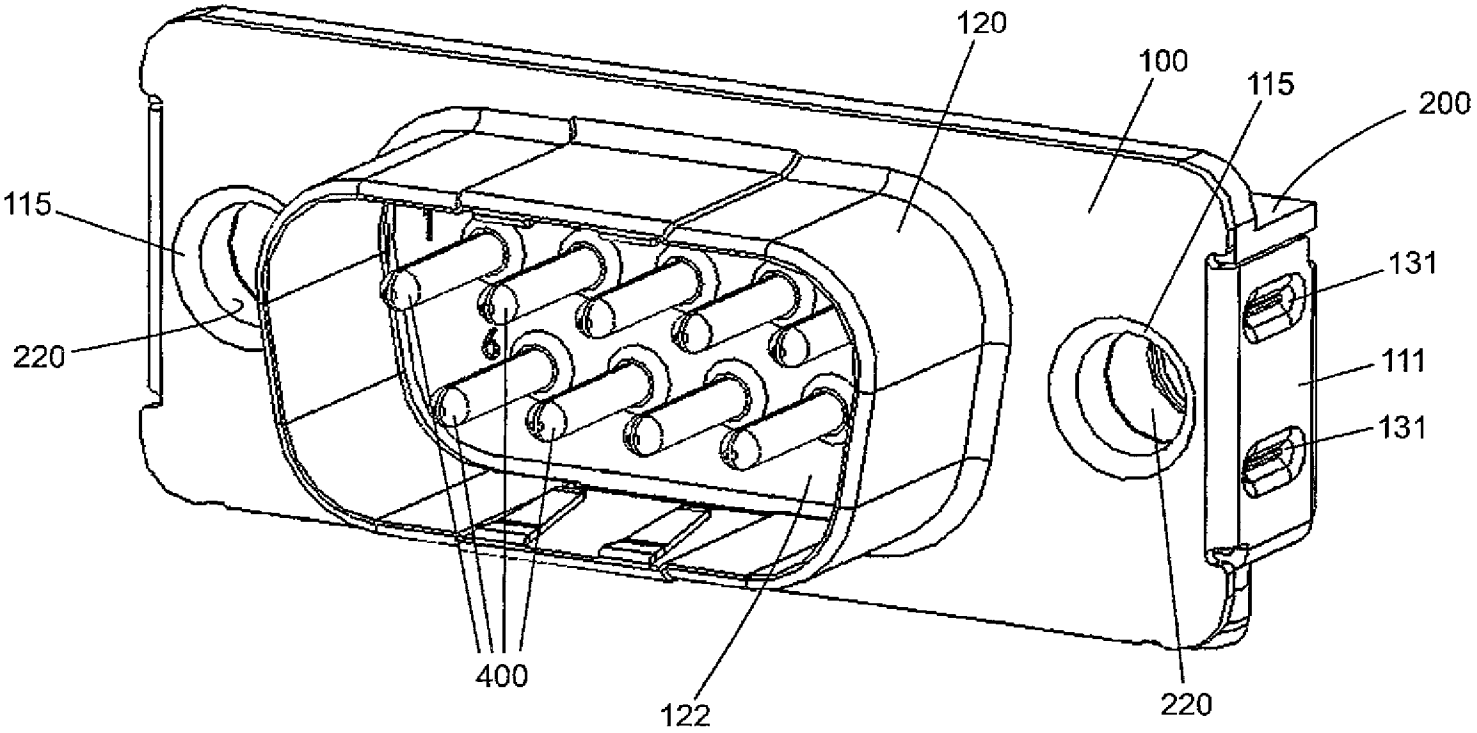
FIG. 5 shows an isometric view of the connector obliquely from the front.

A sub-D connector or also D-sub connector, which is shown in FIGS. 1 to 4 in an isometric view during various production steps and in FIG. 5 obliquely from the front, comprises a base plate 100, on which a plug connector housing 200 is fixed, e.g. glued or injection-molded. A skirt 120, which is generally known and integrally connected to the base plate 100, is arranged on its front side, said skirt surrounding an opening 122 in which the plug contacts such as spring contact elements or blade contact elements 400 are arranged. The plug connector housing 200 which consists of plastic respectively comprises two lateral openings 220 which are used for accommodating screws, bolts or the like for fixing the connector to a housing wall for example. Accordingly, the base plate 100 also comprises openings 114, of which only one thereof is shown in FIGS. 1 to 4. The other opening 115 is arranged on the front side of the connector and is in alignment with the opening 220 of the plug connector housing (FIG. 5). The lateral tabs 110 of the base plate 100 are subdivided into two parts, i.e. a first part 111 and a second part 112. A bead 117 is arranged between these parts 111, 112, which bead is used for the bending-off of the parts 111, 112 of the lateral tabs 110 of the base plate 100, which bending-off will be described below in closer detail. A positioning pin 165 is arranged on the part 111 via a connecting web 160 on its bottom edge facing a printed circuit board (not shown), which positioning pin is used for positioning the connector on the printed circuit board in the known manner. The plastic housing of the plug connector also respectively comprises positioning pins 265.

Figure 1:
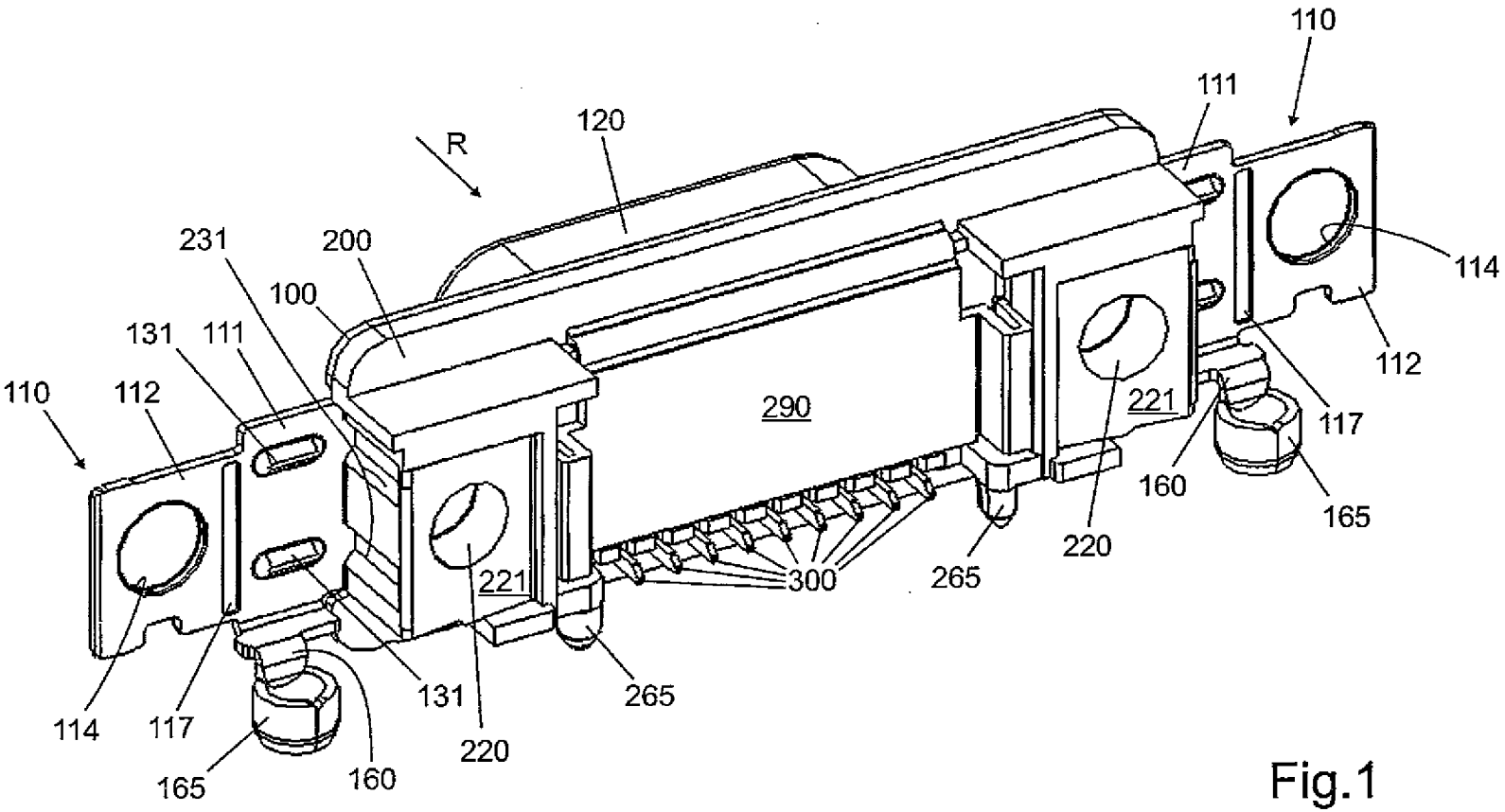
FIG. 1 to FIG. 4 respectively show an isometric view of a connector during various production steps, which connector makes use of the invention.
Figure 2:
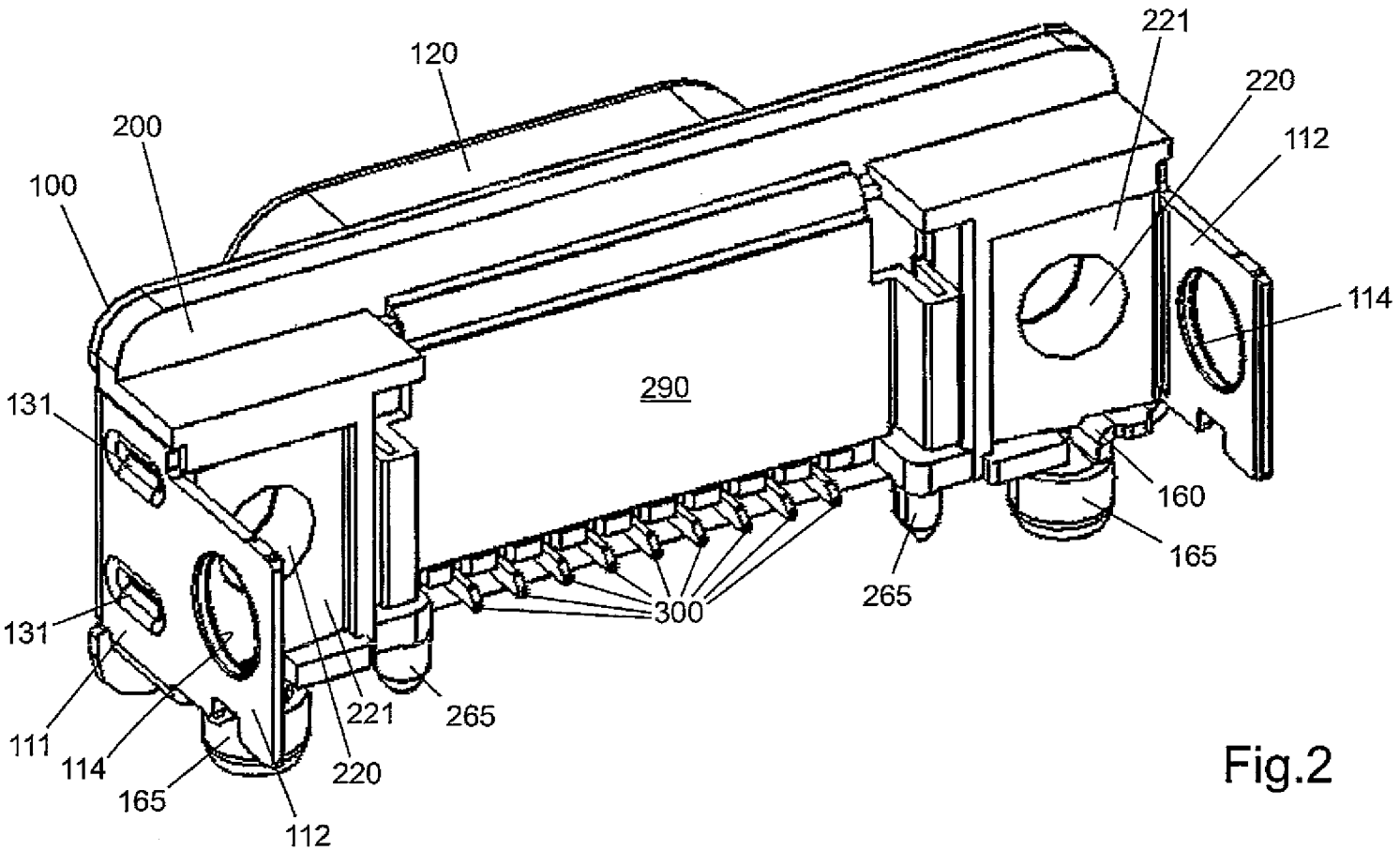
Figure 3:
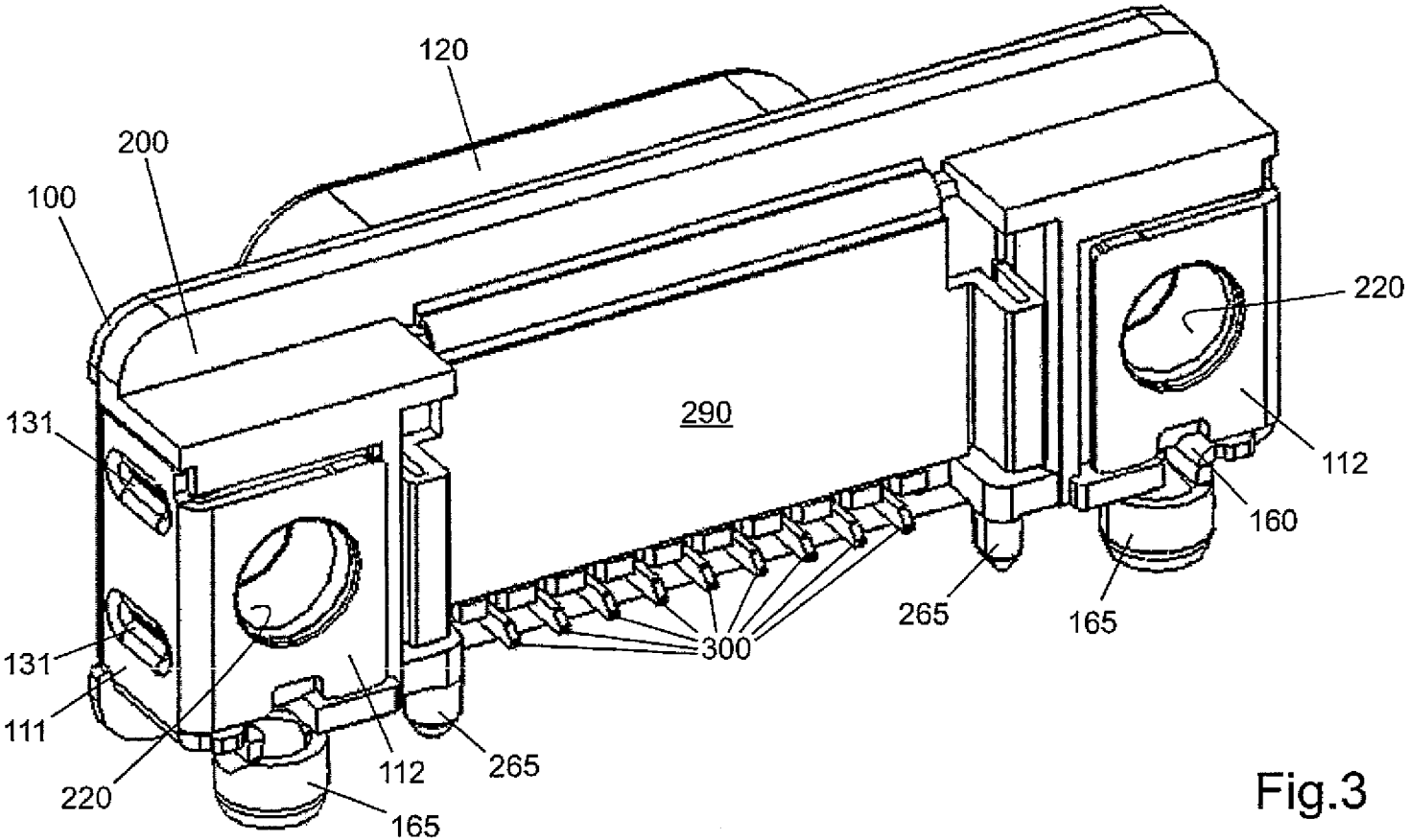
Figure 4:
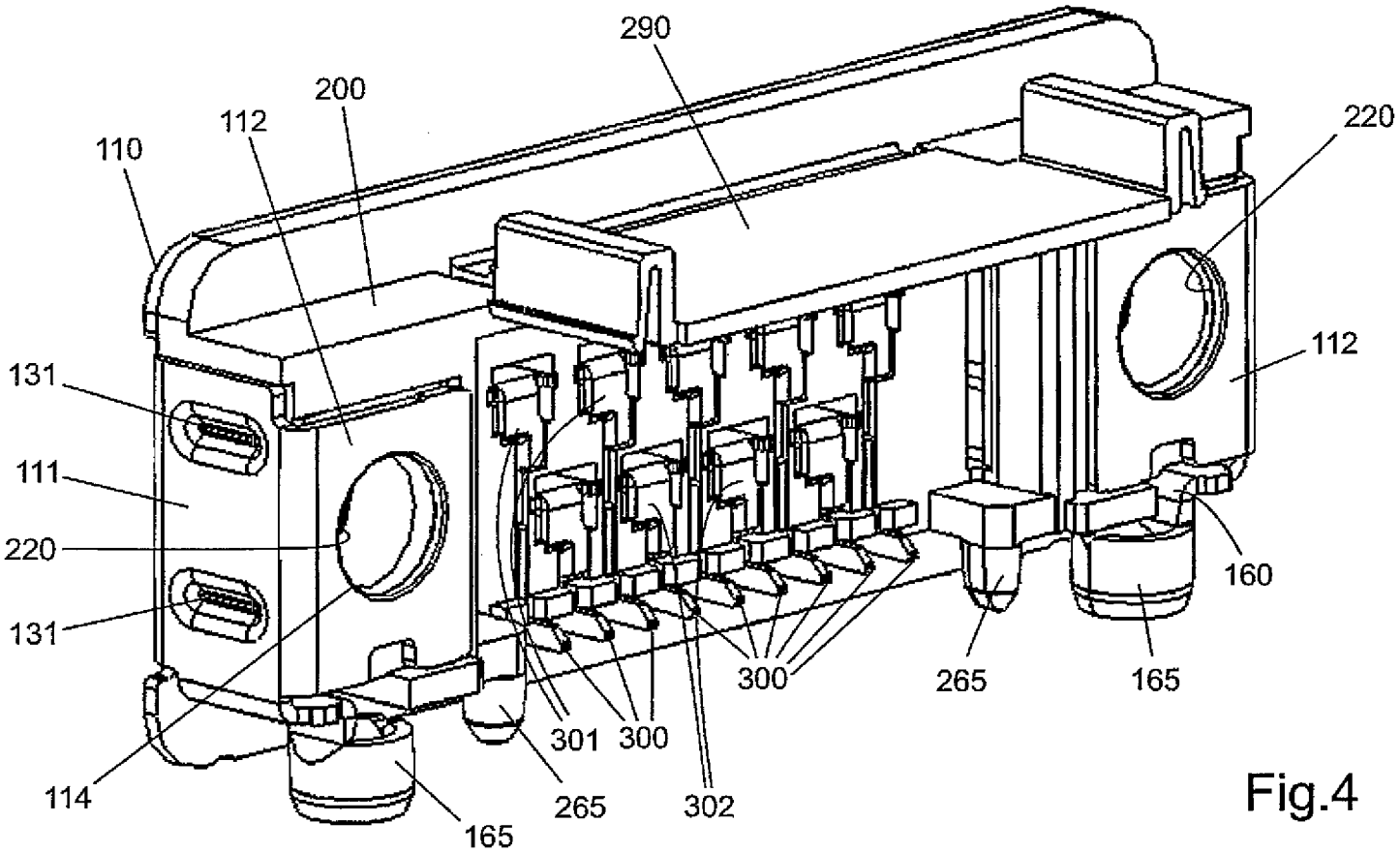

FIG. 1 shows the start of the production method of such a plug connector, in which the plug connector housing 200 is already fixed to the base plate 100. The two tabs 110 do not protrude first in the unbent state laterally beyond the plug connector housing 200. In a first production step, which is shown in FIG. 2, the two tabs 110 are bent at first about 90°, so that the part 111 rests on the plug connector housing 200. As is shown in the drawings, beads 131 can be provided for this purpose in the part 111, which beads engage in respective recesses 231 of the plug connector housing and therefore provide stabilization and/or fixing of the part 111 on the plug connector housing 200. During the bending of the part 111, the positioning pin 165 is simultaneously also brought into position, wherein the connecting web 160, on which the positioning pin 165 is integrally connected to the base plate 100, is positioned parallel to the plug-in direction, indicated by an arrow R in FIG. 1. This arrangement offers the great advantage that bending of the positioning pin 165 in the plug-in direction is virtually excluded. In particular, stability is substantially higher than if the connecting web 160, to which the positioning pin 165 is fixed, extended in the plug-in direction (as shown in FIG. 1 for example), as is the case in plug connectors according to the state of the art. Once this bending process has been completed, it will be followed by a further bending process in which the second parts 112 of the lateral tabs 110 are bent off along the bead 117, so that the second parts 112 come to rest on the rear side of the plug connector 200 in a recess 221 provided for this purpose. The opening 114 is in alignment with the opening 220 in the plug connector housing 200. The fastening of the two parts 111, 112 to the plug connector housing 200 occurs by pressing, gluing or the like.

Contact elements 300 are arranged in the plug connector housing 200, which contact elements are arranged on the front side of the plug as blade contact elements or as spring contact elements in the known manner. These contact elements 300 are arranged as SMD contact elements on the rear side of the connector, i.e. contact elements which can be fixed by surface mounting to a printed circuit board.

The entire connector has a very compact and especially narrow configuration, so that it can be fixed to the edge of a printed circuit board. The contact elements 300 of the connector are visible in FIG. 4. The contact elements 300 are connected via respective connections 301, 302 to respective blade contact or spring contact elements of the sub-D connector, which contact elements are respectively arranged in two rows one on top of the other. Five contact elements are situated in the upper row for example and four contact elements in the bottom row. In order to prevent any inadvertent contact malfunction by touching a metallic component or the like for example during the positioning of the plug connector at the edge of the printed circuit board, a plastic tab 290 is provided on the rear side of the connector, which tab has been injection-molded onto the connector housing 204 for example. The contact elements are exposed by folding up the tab 290, and the contact elements are not only protected against external influences but also insulated by folding down the plastic tab 290.

The connector as described above is characterized by its simple configuration and especially by simple production.

The invention claimed is:

1. A sub-D connector, comprising a base plate (100) to which a plug connector is fastened, positioning pins (165) for positioning on a printed circuit board and lateral fastening openings (220) for accommodating fastening screws or fastening pins, wherein the base plate (100) comprises lateral tabs (110) which are bent twice essentially at a right angle and surround a plug connector housing (200) at the edges, wherein in the state where the tabs (110) are bent twice the fastening openings (220) on the front and rear side of the connector are covered by the tabs (110), wherein the base plate (100) comprises openings (114, 115), which in the state where the tabs (110) are bent twice are in alignment with the fastening openings (220) of the plug connector housing (200), wherein the positioning pins (165) are arranged on the part (111) of the tabs (110) which is bent off once, wherein the lateral tabs (110) respectively comprise beads (117) which are arranged in the region of the rectangular bend-off and are used for defined bending-off, wherein the plug connector housing (200) comprises a plastic tab (290) for insulating the contact elements {300} in the plug connector on the rear side of the connector, and wherein the plastic tab (290) is arranged in a foldable manner on the plug connector housing (200).

2. The connector according to claim 1, wherein the positioning pins (165) are integrally connected by means of a connecting web (160) to the part (111) of the tabs (110) which is bent off once.

3. The connector according to claim 1, wherein the foldable plastic tab (290) is injection-molded onto the plug connector housing (200).

4. The connector according to claim 1, wherein the base plate (100) is a punched part.

5. The connector according to claim 1, wherein the plug connector housing (200) comprises a plastic body in which the plug contacts (400) and contact elements (300) for the printed circuit board are arranged.

6. The connector according to claim 5, wherein the contact elements (300) for the printed circuit board are SMD contacts.

* * * * *